US005413228A

United States Patent [19]

Le Clerc

[11] Patent Number: 5,413,228

[45] Date of Patent: May 9, 1995

[54] COMBINATION DISPLAY DEVICE/STORAGE RACK

[75] Inventor: Joe Le Clerc, Downsview, Canada

[73] Assignee: The Kids Own Co. Ltd., Downsview, Canada

[21] Appl. No.: 994,345

[22] Filed: Dec. 21, 1992

[30] Foreign Application Priority Data

Dec. 10, 1992 [CA] Canada ..... 2085065-5

[51] Int. Cl.[6] ..... A47F 7/00

[52] U.S. Cl. ..... 211/13; 211/14; 211/87; 40/124.4; D6/552

[58] Field of Search ..... 211/13, 14, 87, 88, 211/45, 41; 40/124.4, 124.2, 124, 152, 152.1, 156; D6/552

[56] References Cited

U.S. PATENT DOCUMENTS

| | | | |
|---|---|---|---|
| D. 309,226 | 7/1990 | Wilcox | D6/552 |
| D. 314,302 | 2/1991 | Snow | D6/552 |
| D. 324,793 | 3/1992 | Johnson | D6/552 |
| 3,650,407 | 3/1972 | Benham | 211/14 |
| 4,002,241 | 1/1977 | Panilla | 211/14 X |
| 4,012,858 | 3/1977 | McGregor | 40/152 |
| 5,085,327 | 2/1992 | Mercer et al. | 211/14 X |
| 5,092,062 | 3/1992 | Palka | 40/124.4 X |
| 5,203,462 | 4/1993 | Brooks | 211/14 |

FOREIGN PATENT DOCUMENTS 55266 11/1985 Canada .

OTHER PUBLICATIONS

Copy of Certificate of Registration, Canadian Industrial Design Registration No. 55266.

*Primary Examiner*—Robert W. Gibson, Jr.
*Attorney, Agent, or Firm*—Neil H. Hughes; Ivor M. Hughes; Marcelo K. Sarkis

[57] ABSTRACT

There is provided a storage rack for storing sports equipment including a portion for storing hand held sports equipment, a portion for storing the object affected by the hand held storage equipment, and a portion for storing equipment worn on the hands or head, the improvement including a member for a fixing a sports figurine such as a statue of baseball player, football player, hockey player, tennis player, basketball player or the like to said storage rack thereby providing a rack for functionally storing the said sports equipment and doubling as an award to be given out to members of little league teams or the like. In a preferred embodiment the sports rack may include a device for displaying a flat planer object such as a card photograph or the like for easy removal of said item being displayed and replacement thereof with a second item to be displayed at the whim of the user.

8 Claims, 3 Drawing Sheets

FIG. 1.
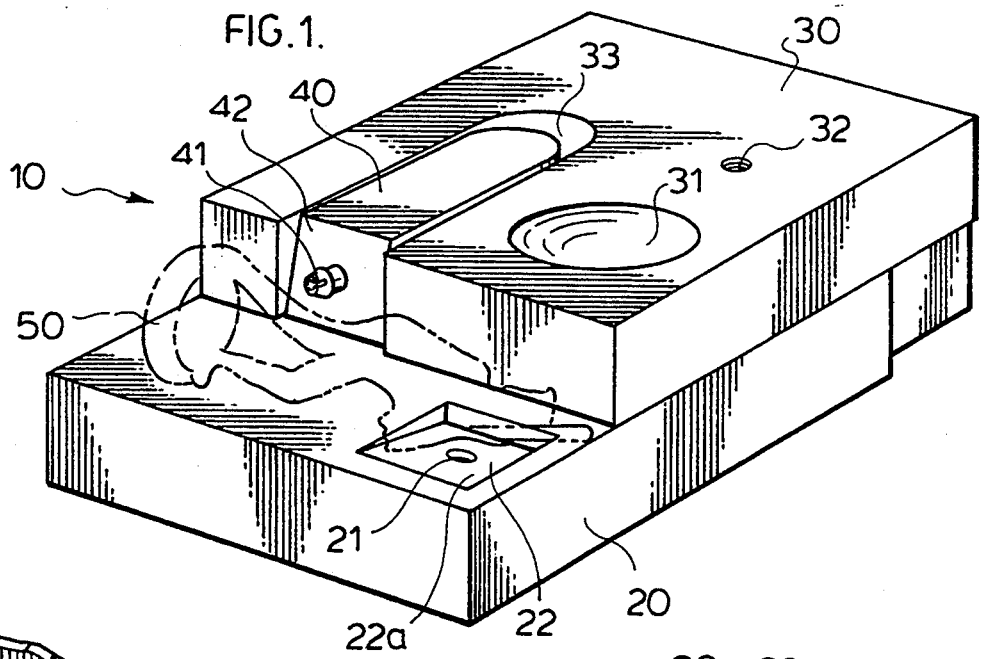
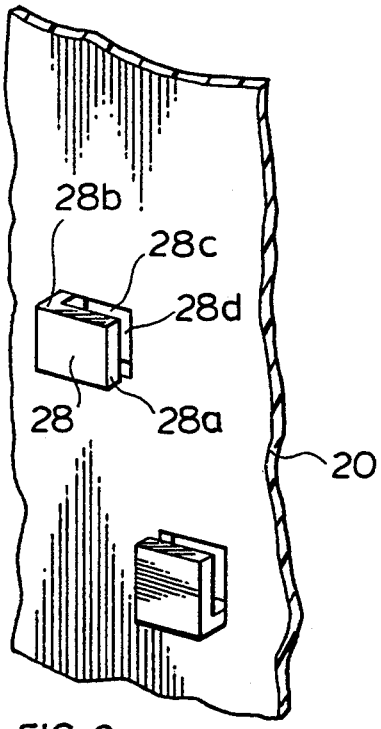
FIG. 3.
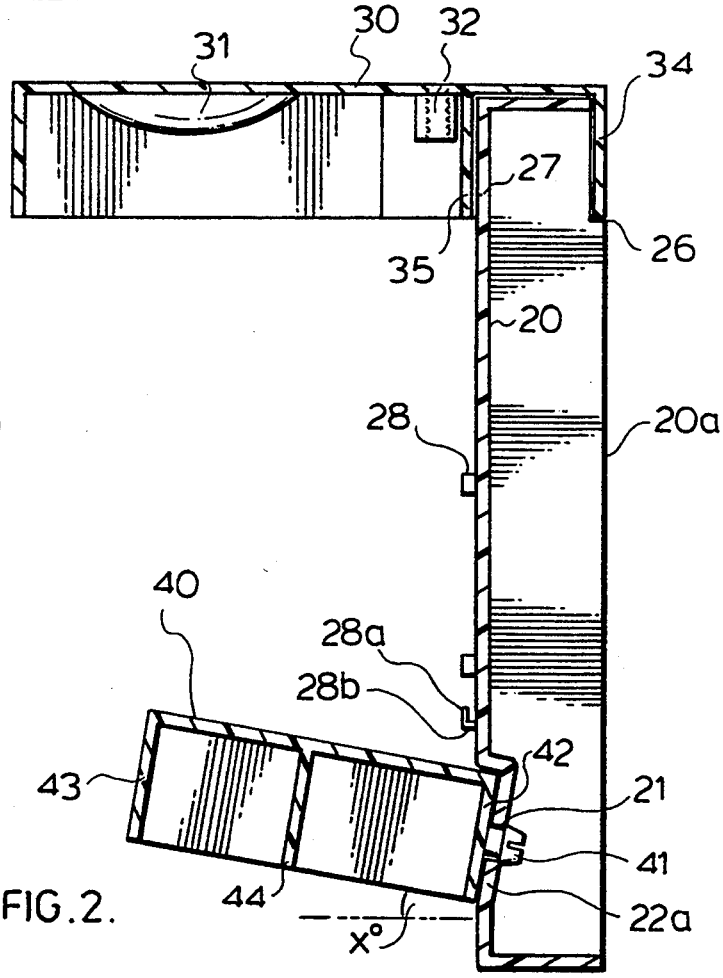
FIG. 2.

COMBINATION DISPLAY DEVICE/STORAGE RACK

FIELD OF INVENTION

This invention relates to storage racks for sports equipment or the like, which incorporates improvements to enhance the value of the storage device to particularly younger sports enthusiast.

BACKGROUND OF THE INVENTION

The assignee of the Applicant had previously filed for and obtained, a Registered Canadian Industrial Design Serial Number 55,266, issued Nov. 19, 1985. The said design, now lapsed to the public domain, illustrates a utility rack made from wood, and when assembled providing a base member normally fasten to a substrate, a top member fasten to the base member and a glove supporting member extending in the same direction as the top member for hanging baseball gloves, hockey gloves, or the like. The top member included a U-shaped channel for holding the handle end of a baseball bat, and a recess within which a baseball or a hockey puck or the like might be retained. This utility rack was mounted for example, in the room of a user, and used for its functional purpose of suspending sports equipment, in a simple manner.

It is also known to provide display devices for collectable cards, such as baseball or hockey cards, which typically are in album form, or if desired, a valuable card may be sealed in a plastic jacket and framed for display purposes.

Heretofore is also known to provide trophies including statues for participants of little league baseball, hockey or the like. These statues are normally mounted on a base and carry an engraved message on the base, indicating the type of award.

Nowhere within the prior art is there provided a utility rack which may be awarded to a member of the baseball team or hockey team, which includes the provision of a statue and in a preferred embodiment an award plaque, thereby providing both utilitarian and emotional value to the recipient.

Further, it is often the case that such previously mentioned awards or sports storage items may contain the logo of a favorite team. However once such a logo is formed or placed on an article the logo becomes fixed in relation to the article.

Nowhere within the prior art is there found a utility rack for storing sports equipment that also enhances the value thereof, by adding the emotional pleasure of also serving as an award, or mile stone recognition and complementary thereto includes means for temporarily storing a sports fans favorite playing card, athletes picture, logo or the like.

It is therefore a primary object of the invention to provide a combination utility sports rack and award.

It is yet a further object of the invention to provide a combination utility sports rack, and display device.

It is yet a further object of the invention to provide a combination of a utility sports rack, award, and display device.

Further another object of the invention will become apparent to a man skilled in the art when considering the following summary of the invention in the more detailed description of the preferred embodiments illustrated herein.

SUMMARY OF THE INVENTION

According to a primary aspect of the invention there is provided a combination utility rack/display device comprising a first member having two sides and a top surface, said first member having extending from proximate one side thereof means for storing hand held sports equipment (for example, a baseball bat, tennis racket, hockey stick or the like) and preferably, also providing means for retaining and storing the object to be effected by the hand held apparatus, the first member having disposed proximate the side thereof remote said means for storing said hand held apparatus, means for storing equipment on at least one hand of a participant, (for example, baseball gloves, hockey gloves, and other sports gloves), the improvement comprising display means for displaying a flat planer member (such as a baseball, football, or hockey card, or the like or the picture of a favorite athlete, the logo of a favorite team, the picture of a baseball team or league, within which the user participates or the like) preferably the display means further comprising, portions raised from the top surface of the first member preferably formed from thermoplastic or a thermoset materials, which portions are laterally raised away from the top of the first member so as to provide therebetween a hollow within which the edge of a card may be inserted so as to display the flat planar member yet retain it on preferably three sides of the flat planar member, the fourth side being left open to allow the easy insertion or removal of the flat planar member, preferably said rack/display device further comprising means for mounting a statue therewith (preferably said statue being the image of a hockey, baseball, football, basketball, golfer, tennis star, or the like), preferably said display device carrying a message coinciding with the type of statue being display, wherein said rack combination may be used not only as a storage device but has the added value of serving as a functional award for little leagues (for example baseball, hockey, golf, tennis teams) thereby adding emotional value to the storage rack and which in a preferred embodiment includes a display means for displaying a flat planer object such as a favorite baseball card.

According to yet another aspect of the invention there is provide a storage rack for storing sports equipment comprising means for storing hand held sports equipment, means for storing the object affected by the hand held storage equipment, and means of storing equipment worn on the hands or head, the improvement comprising means for a fixing a sports figurine such as a statue of baseball player, football player, hockey player, tennis player, basketball player or the like to said storage rack thereby providing a rack for functionally storing the said sports equipment and doubling as an award to be given out to members of little league teams or the like. In a preferred embodiment the sports rack may further comprise means for displaying a flat planer object such as a card photograph or the like for easy removal of said item being displayed and replacement thereof with a second item to be displayed at the whim of the user. In a preferred embodiment said means for displaying a flat planer object includes tabs raised from the displaying surface of said storage rack.

According to yet another aspect of the invention there is provided an improved storage rack comprising means for a fixing a sports figurine such as a statue of baseball player, football player, hockey player, tennis player, basketball player or the like to said storage rack thereby providing a rack for functionally storing the said sports equipment and doubling as an award to be given out to members of little league teams or the like. In a preferred embodiment the sports rack may further comprise means for displaying a flat planer object such as a card photograph or the like for easy removal of said item being displayed and replacement thereof with a second item to be displayed at the pleasure of the user. In a preferred embodiment said means for displaying a flat planer object includes tabs raised from the displaying surface of said storage rack.

According to yet another aspect of the invention there is provided a storage rack comprising display means for displaying a flat planer object proximate a readily observable surface of a storage rack preferably said display means including tang portions or tabs raised laterally away from said surface so as to provide a groove between said tang and said surface within which a flat planer may be inserted and secured preferably proximate three sides thereof with the fourth side being left open to allow for easy insertion and removal of said flat planer object. In a preferred embodiment said rack may further comprise a statue of an action figurine such as a baseball player, golfer, football player, basketball player, hockey player and tennis player or the like, and preferably includes a message such as an engraved plaque mounted proximate one side thereof so as to provide the added value to the rack of being a storage device combination, display device combination award.

Therefore there is provided a kit of components for storing and displaying sports equipment or the like which when assembled forms a combination storage/-display device which includes a base upon which the storage/display device may be assembled, an arm portion extending laterally away from the base when assembled and fastened thereto, and a storage/display portion which is affixed to said base and which provides for the storage and display of sports equipment and sports memorabilia, and preferably said base member including tang portions extending upwardly away from said base so as to provide with a multiplicity of said tang portions a recess within which a flat planer member may be retained or displayed against said base, wherein said storage/display portion interfits with said base by a friction fit of abutting portions provided proximate the bottom of said storage/display portion and proximate the top of said base portion, so as to secure said storage/display portion upon said base, said base having means provided therewith for anchoring said base to a substrate such as a wall or the like, and said arm including fastening means proximate one end thereof to anchor within a pocket on said base so as to provide a press fit between said fasten means and fastening means disposed within pocket in said base, said pocket within said base being provide with a angularly disposed wall so as to incline the fastened arm at an angle to the horizontal and extending toward said storage/display portion, said arm, said storage/display portion and said base being made from thermoplastic or thermoset materials and including web portions to reinforce said arm, storage/display portion, and said base when assembled, said storage/display portion further including means for supporting a figure of an athlete such as a baseball player, hockey player or the like, and preferably means to display a message proximate the side of the storage/-display portion, wherein said device when assembled may be used as both a storage device and a display device for an award or other memorabilia.

BRIEF DESCRIPTION OF THE DRAWINGS

FIG. 1 is a perspective view of the combination rack and display devise illustrated in a preferred embodiment of the invention.

FIG. 2 is a cross section of the assembled unit illustrated in side plan view in a preferred embodiment of the invention.

FIG. 3 is a close up perspective view of the tag portions 28 of FIG. 2 illustrated in a preferred embodiment of the invention.

DETAILED DESCRIPTION OF PREFERRED EMBODIMENTS OF THE INVENTION

Figure 4:
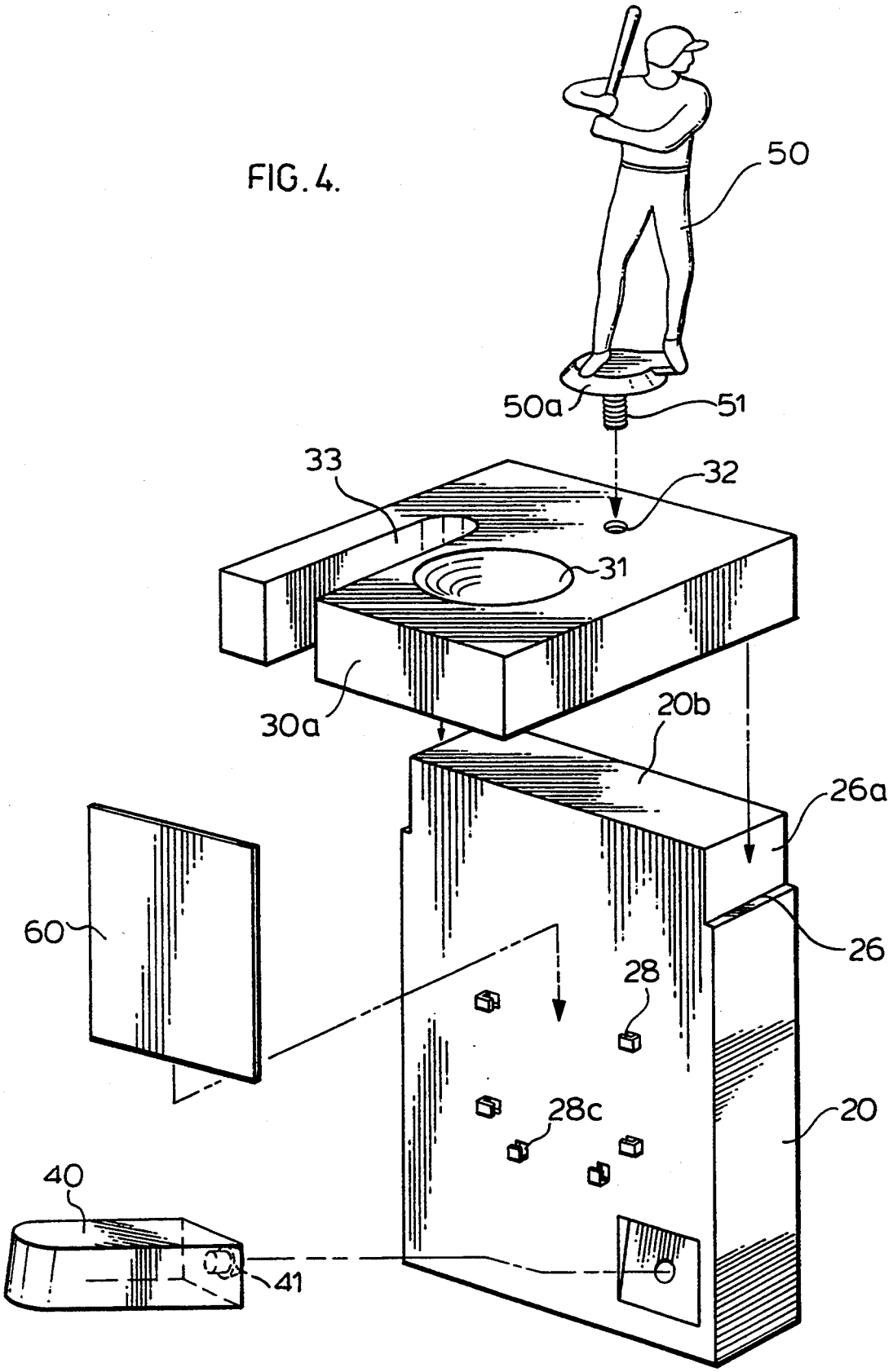
FIG. 4 is an exploded perspective view of the components of the unit illustrated in a preferred embodiment of the invention.

Referring now to FIG. 1 there is illustrated a disassembled combination storage/display device as received by the user and normally included in a packaging of polyethylene materials. The storage/display devise 10 includes a base 20 upon which the device is assembled. A base 20 includes an opening 21 compatibly shaped to receive the fastener 21 of arm 40 within the recess 22 so that the tapered wall 42 abuts with the tapered wall 22*a* of the recess 22 as best seen in relation to FIG. 2. The arm 40 of FIG. 1 is contained for packaging purposes within a generally U-shaped slot 33 of the top portion 30 of the combination storage/display unit.

The top portion 30 has provided therewith a recess 32 which is threaded to receive the threaded end 51 of the statue 50. The statue 50 is contained within the package in the manner shown. The top portion 30 of the unit 10 includes a hemispherical recess 31 for storing or displaying an autographed baseball 70 as best seen in relation to FIG. 5.

Therefore there is provided a kit of components for storing and displaying sports equipment or the like which when assembled forms a combination storage/-display device which includes a base upon which the storage/display device may be assembled, an arm portion extending laterally away from the base when assembled and fastened thereto, and a storage/display portion which is affixed to said base and which provides for the storage and display of sports equipment and sports memorabilia, and preferably said base member including tang portions extending upwardly away from said base so as to provide with a multiplicity of said tang portions a recess within which a flat planer member may be retained or displayed against said base, wherein said storage/display portion interfits with said base by a friction fit of abutting portions provided proximate the bottom of said storage/display portion and proximate the top of said base portion, so as to secure said storage/display portion upon said base, said base having means provided therewith for anchoring said base to a substrate such as a wall or the like, and said arm including fastening means proximate one end thereof to anchor within a pocket on said base so as to provide a press fit between said fasten means and fastening means disposed within pocket in said base, said pocket within said base being provide with a angularly disposed wall so as to incline the fastened arm at an angle to the horizontal and extending toward said storage/display portion, said arm, said storage/display portion and said base being made from thermoplastic or thermoset materials and including web portions to reinforce said arm, storage/display portion, and said base when assembled, said storage/display portion further including means for supporting a figure of an athlete such as a baseball player, hockey player or the like, and preferably means to display a message proximate the side of the storage/-display portion, wherein said device when assembled may be used as both a storage device and a display device for an award or other memorabilia.

Referring now to FIG. 2 there is illustrated the components of FIG. 1 assembled into a storage/display device. Therefore said base 20 is anchored to a wall or the like proximate the rear wall 20*a* thereof. This feature is not shown but is conventional for many storage type items as would be known to those skilled in the art. The base therefore 20 includes a portion which has an undercut portion 26 disposed proximate each side thereof as best seen in relation to FIG. 4. The undercut portion 26 includes an upwardly extending wall 26*a* and a laterally extending wall 26*b*. Therefore a portion 20*b* is described at the top of said base 20 which provides a press fit with the flanges 34 and 35 disposed upon-the bottom of the top portion 30 as best seen in FIG. 2. The base portion 20 also included a pocket 22 having a tapered bottom 22*a* which cooperates with tapered bottom 42 of arm 40 so as to incline the arm 40 at an angle of X degrees to the horizontal so that said arm 40 may retain a baseball mitt or the like 90 as best seen in FIG. 5. The front end 43 of arm 40 is rounded so as to properly fit within the U-shaped channel 33 as best seen in figure I when the unit 10 is disassembled when first acquired. A threaded recess 32 is provided proximate the top portion 30 for affixing said statue 50 via the threaded portion thereof 51 proximate the bottom of the base 50*a* of said statue 50. In the preferred embodiment the statue 50 comprises a figure of a baseball player holding a baseball bat. The top portion 30 also includes a hemispherical recess 31 within which a baseball, which may be autographed, or a puck, should the FIG. 50 be a hockey player, may be retained.

Figure 5:
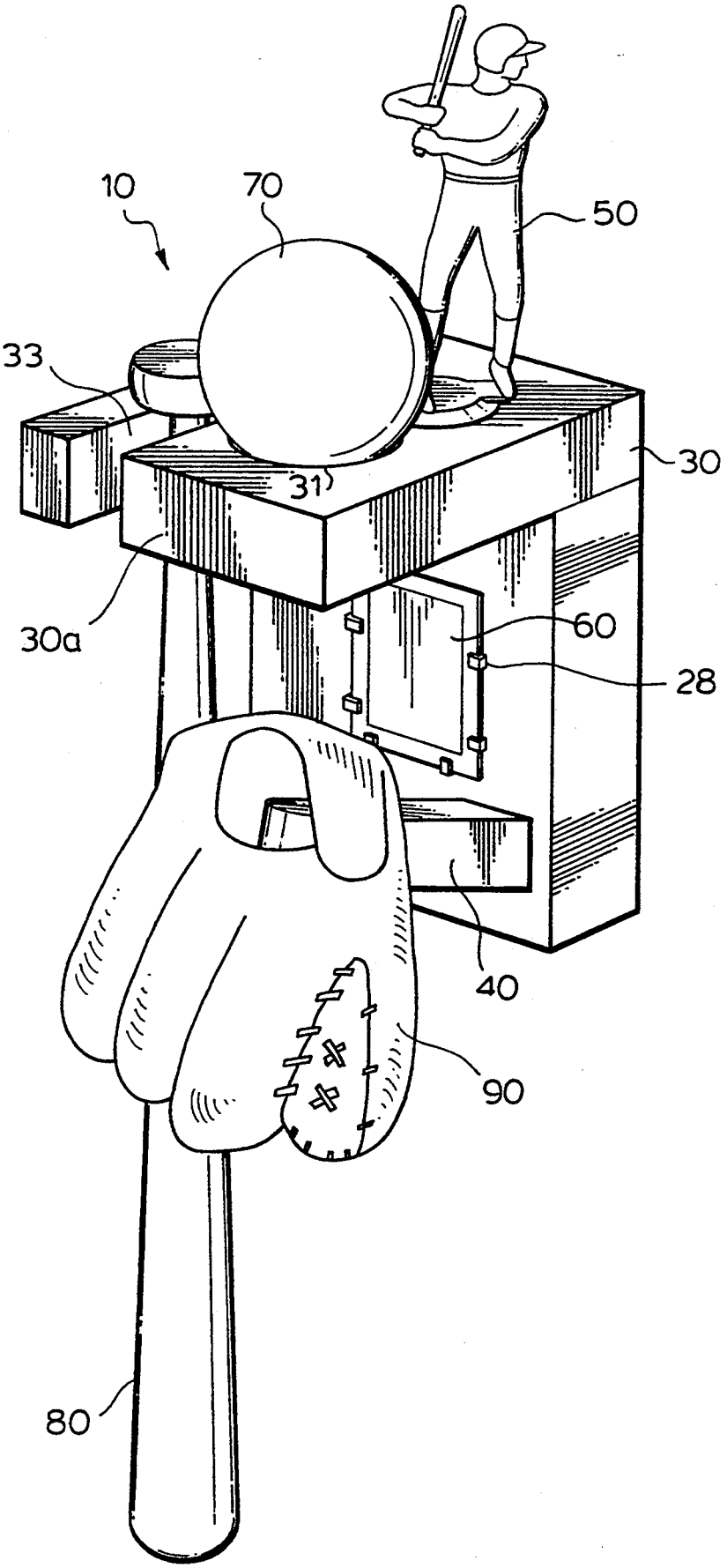
FIG. 5 is a perspective of the unit of FIG. 4 in use and illustrated in a preferred embodiment of the invention.

Referring now to FIG. 3, 4 and 5 there is provided upon the base 20 upwardly extending tang portions or tab portions 28 which are raised laterally away from the side of the base 20. As seen in FIGS. 4 and 5 six of these tabs are provided, two proximate each side of the display device 10 and two proximate the bottom thereof. Specifically as best seen FIG. 3 the tangs 28 include a laterally extending portion 28*a*, substantially parallel to the surface of base 20 from which they are formed but offset a predetermined distance defined by an outwardly extending flange 28*b*. The parallel flange 28*a* is offset a distance 28*c* from said surface of base 20. Of course in providing said tangs 28 an opening is provided at 28*d* of said surface of said base member 20. Therefore said space 28*c* for each tag 28 defines a grove within which a flat planer member 60 maybe inserted or from which a flat planer member 60 may be removed as best seen in FIGS. 4 and 5. Said flat planer member 60 may be a team picture for which the user of said unit 10 may have participated, or it may be a favorite baseball card as supplied by known baseball card suppliers, or other sports cards, it may be a flat card containing a logo or a favorite picture or the like. However in providing said tangs 28 the invention provides means for retaining a favorite picture or the like and readily removing said picture and replacing it with another favorite card or picture at any point in time.

As best seen in FIG. 5 the unit 10 is utilized to retain an autograph baseball 70, a statue 50, a favorite picture 60, within the groves defined by tangs 28, a baseball mitt 90 upon the arm 40 and baseball bat 80 retained in the generally U-shaped channel 33. Further an engraved plate, not shown, may be affixed to side surface 30*a* of said top 30 so that said combination storage/display device may also serve as an award for a young athlete. In doing so tang portions 28 may also be provided on surface 30*a* so as to allow easy insertion of a flat planar substrate containing a message.

As many changes can be made to the invention without departing from the scope of the invention; it is intended that all material contained herein by interpreted as illustrative of the invention and not in a limiting sense.

THE EMBODIMENTS OF THE INVENTION IN WHICH AN EXCLUSIVE PROPERTY OR PRIVILEGE IS CLAIMED ARE AS FOLLOWS:

1. A combination utility rack/display device comprising a first member having two sides and a top surface, said first member having extending from proximate one side thereof means for storing hand held sports equipment, and also providing means for retaining and storing the object to be effected by the hand held sports equipment, the first member having disposed proximate the side thereof remote said means for storing said hand held sports equipment, means for storing equipment worn on at least one hand of a participant, the improvement comprising display means for displaying a flat planer member, the display means further comprising, portions raised from the top surface of the first member which portions are laterally raised away from the top of the first member so as to provide therebetween a hollow within which the edge of a card may be inserted so as to display the flat planar member yet retain it on the sides of the flat planar member, at least the fourth side being left open to allow the easy insertion or removal of the flat planar member, said rack/display device further comprising means for mounting a statue therewith said display device carrying a message coinciding with the type of statue being displayed, wherein said rack combination may be used as a storage device and a functional award for little leagues.

2. A storage rack for storing sports equipment comprising means for storing hand held sports equipment, means for storing the object affected by the hand held sports equipment, and means of storing equipment worn on the hands or head, the improvement comprising means for fixing a sports figurine to said storage rack, thereby providing a functional rack and an award.

3. An improved storage rack comprising means for a fastening a sports figurine to said storage rack and means for displaying a flat planer object, for easy removal of said flat planar object and replacement thereof with a second flat planar object to be displayed at the pleasure of the user, the storage rack thereby providing a rack for functionally storing sports equipment and doubling as an award.

4. The sports rack of claim 3 wherein said means for displaying a flat planer object includes tabs raised from the displaying surface of said storage rack.

5. A storage rack comprising display means for displaying a flat planer object proximate a readily observable surface of a storage rack said display means including tang portions or tabs raised laterally away from said surface so as to provide a groove between said tang and said surface within which a flat planer may be inserted and secured proximate the sides thereof with the at least the fourth side being left open to allow for easy insertion and removal of said flat planer object, wherein said rack further comprises a statue of an action figurine and includes a message such as an engraved plaque mounted proximate one side thereof so as to provide the added value to the rack of being a storage device combination, display device combination award.

6. A kit of components for storing and displaying sports equipment which when assembled forms a combination storage/display device which includes a base upon which the storage/display device may be assembled, an arm portion extending laterally away from the base when assembled and fastened thereto, and a storage/display portion which is affixed to said base and which provides for the storage and display of sports equipment and sports memorabilia, said base member including tang portions extending upwardly away from said base so as to provide with a multiplicity of said tang portions a recess within which a flat planer member may be retained or displayed against said base, wherein said storage/display portion interfits with said base by a friction fit of abutting portions provided proximate the bottom of said storage/display portion and proximate the top of said base portion, so as to secure said storage/display portion upon said base, said base having means provided therewith for anchoring said base to a substrate such as a wall or the like, and said arm including fastening means proximate one end thereof to anchor within a pocket on said base so as to provide a press fit between said fastening means and fastening means disposed within pocket in said base, said pocket within said base being provide with a angularly disposed wall so as to incline the fastened arm at an angle to the horizontal and extending toward said storage/display portion, said arm, said storage/display portion and said base being made from thermoplastic or thermoset materials and including web portions to reinforce said arm, storage/display portion, and said base when assembled, said storage/display portion further including means for supporting a figure of an athlete and means to display a message proximate the side of the storage/display portion, wherein said device when assembled may be used as both a storage device and a display device for an award or other memorabilia.

7. The sports rack of claim 2 further comprising means for displaying a flat planer object such as a card photograph for easy removal of said item being displayed and replacement thereof with a second item to be displayed at the whim of the user.

8. The sports rack of claim 7 wherein said means for displaying a flat planer object includes tabs raised from the displaying surface of said storage rack.

* * * * *